United States Patent [19]

Lanzl

[11] 4,299,345

[45] Nov. 10, 1981

[54] BALL HOLDER AND DISPENSER

[76] Inventor: Joseph E. Lanzl, 259 Gardner Ave., South Orange, N.J. 07079

[21] Appl. No.: 186,703

[22] Filed: Sep. 12, 1980

[51] Int. Cl.[3] ..... A47F 1/08

[52] U.S. Cl. ..... 224/252; 224/919; 221/309; 221/310

[58] Field of Search ..... 224/252, 251, 242, 919, 224/45 L; 206/315 B; 150/1.5 C; 211/14, 15, 49 D; 221/307, 309, 310; 222/175, 528

[56] References Cited

U.S. PATENT DOCUMENTS

| | | | |
|---|---|---|---|
| 2,768,775 | 10/1956 | Houser | 224/919 X |
| 3,206,067 | 9/1965 | Smith, Jr. et al. | 221/309 |
| 3,435,988 | 4/1969 | Jonas et al. | 221/310 |
| 3,790,023 | 2/1974 | Filipowicz | 221/310 X |
| 4,042,156 | 8/1977 | Knight | 224/919 X |
| 4,068,785 | 1/1978 | Goudreau | 224/919 X |
| 4,072,256 | 2/1978 | Young | 224/919 X |
| 4,106,678 | 8/1978 | Thomas | 221/309 X |

*Primary Examiner*—Steven M. Pollard
*Attorney, Agent, or Firm*—Robert D. Farkas

[57] ABSTRACT

A ball holder and dispenser utilizes a substantially hollow cylindrical rigid container, having both ends open. Each open end is configured to resist the injection or exiting of the balls, otherwise capable of being stored therewithin. The mechanism is provided with an elongated slot extending along a portion of the exterior surface of the cylinder, facilitating the injection of the lowermost ball by passing such lowermost ball through an overcomeable retaining mechanism. The balls may be retained in preferred locations within the cylinder prior to ejection. The cylinder is provided with means for removably attaching the cylinder to portions of the users clothing, thereby permitting the apparatus to be carried by the user during the playing of games involving the use of one or more balls stored within the container.

10 Claims, 6 Drawing Figures

BALL HOLDER AND DISPENSER

BACKGROUND OF THE INVENTION

1. The Field of the Invention

This invention relates to ball carrying devices and dispensers, adapted for portable use, specifically permitting one ball at a time to be easily dispensed therefrom, during the playing of games, such as tennis, golf, and the like.

2. Description of the Prior Art

The prior art abounds with portable mechanisms, which mechanisms permit one or more balls to be carried about, from place to place, by a player.

U.S. Pat. No. 4,042,156, issued Aug. 16, 1977 to Lynn E. Knight teaches an improved tennis ball carrier adapted to be carried on the person of a player comprises an axial structure divided into two axially aligned compartments and provided with a retaining lip at the mouth of each opposed open end, at lease one side opening or means permitting fingers to access the mouth-opposing back side of an enclosed tennis ball and means for maintaining a snug hold on enclosed tennis balls under playing conditions, but which still permits ready access to the back side of the ball. A belt or other clothing attachment may be provided permitting a player to harness the device to the body. A tennis ball held by the device may be released by applying finger pressure to the back side of the enclosed tennis ball compressing the ball sufficiently while urging it past the lip retaining it in the enclosure. Such device is limited to the retention of two balls, and, causes such balls to be constantly under some stress when the balls are maintained within the compartments.

U.S. Pat. No. 4,068,785, issued Jan. 17, 1978 to Noel G. Goudreau, discloses a ball holder connector construction, particularly adapted for snap connecting a base and a retaining ring of a ball holder. A base connector tongue is formed integral with the base. An aperture is formed in the base connector tongue. A retaining ring connector tongue is formed integral with the retaining ring. The regaining ring connector tongue has a hook formed integral therewith, which is adpated to pass through the aperture of the base connector tongue. The hook is adapted to engage lockingly the base connector tongue. The base connector tongue and the retaining ring connector tongue together comprise the ball holder connector. Such device is suitable for retaining one ball only, which ball, when released permits the retaining ring connector tongue to be detached from the base, enhancing the possibility that the apparatus can be disfunctional when such tongue is lost.

U.S. Pat. No. 4,072,256, issued Feb. 7, 1978 to Daniel L. Young relates to a portable ball-holding device for carrying tennis balls or the like and which can be worn by the player at the small of the back in an unobstrusive manner. A substantially flat base member has a facing surface, a reverse surface and a plurality of projections extending from the facing surface and mutually spaced to define a plurality of ball receiving regions each dimension to removably receive one ball. Each projection is provided with an enlarged head portion at the distal end to facilitate retention of a ball.

Several alternate means for attaching the holding device to a carrying member include a central portion of the base member and a pair of flanking flexible tab members formed so that the tab members may be inserted into the waistband of a player's garment, with the rear surface of the base member and the front surface and the free end of each tab member textured to provide improved frictional engagement with the player's garment; and adhesion means secured to the reverse surface of the base member for releasable attachment to a complementary adhesion means secured to the player's garment; and a pair of slots formed in opposing edges of the base member through which a fabric or leather belt may be passed to secure the device around the player's waist.

A cover member fabricated from transparent plastic forms a protective package for the balls, which may also function as a pressurized original sale carton by providing a rupturable seal at the junction between the cover portion and the base member. A user is mandated to grasp the ball desired to be withdrawn, by engaging such ball with at east two fingers, such fingers often coming into contact with the other balls stored within the apparatus. The enlarged head portions of the projections limit the ease in which the balls may be withdrawn selectively and, prevent the balls from accidentally being dispensed from the holder. Clearly, an optimum relationship between ease of withdrawing a desired ball and retaining such desired ball is difficult to achieve by this disclosure.

SUMMARY OF THE INVENTION

A primary object of the present invention is to provide a ball holder and dispenser in which an unlimited number of balls may be easily stored, easily withdrawn, and carried about during the playing of various games.

Another object of the present invention is to provide a ball holder and dispenser which is light in construction, inexpensive to manufacture, and particularly suited for its intended use.

Still another object of the present invention is to provide a ball holder and storage container which positions one or more balls in preferred locations along designated positions of a common storage track, thereby eliminating the possibility of one ball rubbing on another, causing the exterior surface of such balls to become degraded, worn, or otherwise subject to undue forces.

Yet another object of the present invention is to provide a ball carrying dispensing container which permits the dispensing of balls outwardly through a specially prepared dispensing end, without requiring the user to insert more than one finger into the apparatus during the dispensing mode of operation thereof.

A further object of the present invention is to provide a container for carrying balls about which may be utilized during the sale of such balls as a storage container.

Another object of the present invention is to provide a ball dispenser which may be easily secured to a portion of the user's clothing, in one mode of operation, acting as a storage device for the balls, in another mode of operation, and also acting as a container, suitable for the sale of such balls.

The present invention envisioned the use of a substantially right angle hollow cylindrical device having two open ends, at the opposite ends thereof. One of such open ends, being the end which is adapted for uppermost use, when worn by the user, is provided having a diameter slightly smaller than the maximum diameter of the ball intended to be stored within, and dispensed outwardly from such container. The same uppermost end is provided having a elongated notch communicating thereto wherein such notch extends substantially downwardly towards, but not through to, the lowermost open end of the device. If desired, such notch can, in fact, extend through from the uppermost end to the lowermost end of the device, running substantially parallel to the longitudinal central axis of the cylindrical-like housing-like container. The lowermost end of the apparatus is provided having a pair of internal arcuately shaped plates, such plates extending slightly inwardly from the diameter defining said lowermost end. Thus, a ball communicating with the lowermost open mouth region of the cylindrical device utilized as a housing, experiences communication with such arcuately shaped plates. Judicious configuration of the plates, adapted to exert a stopping force against a portion of the exterior surface of the ball, retains such ball within the housing. However, upon applying a substantial force to the ball, in a downward direction, causes such arcuately shaped plates to move radially outwardly, permitting the ball to pass outwardly from the lowermost opening of the cylinder. A plurality of protrusions, spaced about the interior of the cylindrical housing, positions balls at preferred locations along the interior length of the housing, thereby precluding ball to ball contact, and, minimizing the frictional engagement of the balls to one another. A loop-like device, or, if desired, a hook-like device, may be affixed to the exterior surface of the cylindrical housing at a region opposite the elongated notch. Such loop or hook-like devices may be utilized to secure the apparatus to portions of the user's clothing, such as by passing a portion of the belt through the loop-like device or by permitting the free end of the hook-like device to pass in between the interior portion of the belt and portions of the user's waist. The entire apparatus, including two or more balls, depending upon the length of the cylindrical housing, may be secured within a plastic film, such plastic film being shrunk through conventional means, to comprise a package suitable for storing balls, container, and advertising media therewithin in a neat, inexpensive, and totally functional sales oriented package. Upon removal of the plastic shrunk overlay, the ball carrier and dispenser, complete with balls contained therein, may be attached to portions of a user's clothing and immediately be utilized in the playing of various games. It is anticipated that the present invention can be worn by tennis players, golf players, baseball players, and other game players involving bals, pucks, discs, or similar spherical or disc-like shaped devices.

These objects as well as other objects of the present invention will become more readily apparent after reading the following description of the accompanying drawings.

Figure 1:
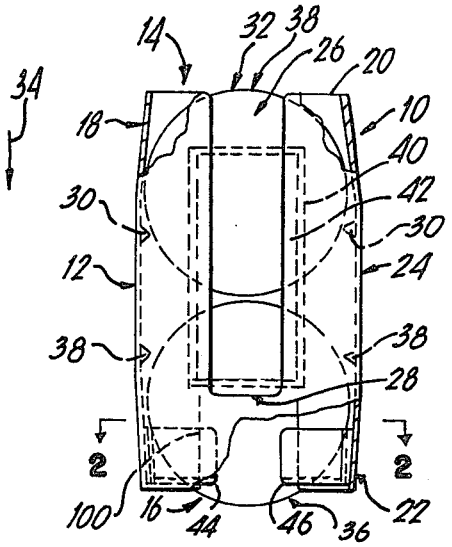
FIG. 1 is a front elevation view of the present invention.

The structure and method of fabrication of the present invention is applicable to a ball holder and dispenser comprising a substantially cylindrical housing. Such cylindrical housing is provided having two open ends. One of such open ends includes a notch extending substantially parallel to the longitudinal axis of the housing, down towards an ending substantially adjacent to the other open end thereof. In an alternate embodiment, such notch can communicate between both open ends of the housing. Disposed within the other open end of the housing are two arcuately shaped plates, each being attached to the interior of the housing, and each defining an internal diameter slightly less than the internal diameter of the adjacent open end. Affixed within the interior of the cylindrical housing are a plurality of protrusions or projections, each being adapted to engage the portions of the exterior surface of a ball so as to restrict such ball to a preferred location. However, such protrusions or projections are configured to permit the ball to pass from such preferred location to an adjacent preferred location, or if desired, to pass outwardly from the housing by overcoming the rest or normal position of the two arcuately shaped plates and merging outwardly from the open end adjacent to the location thereof. A boss or other plate-like struture is attached to the exterior of the housing at a location opposite the notch. To such boss or plate-like structure a device, suitable for attaching the cylindrical housing to a portion of the user's clothing, is secured. Such device, may include a clip-like apparatus, being in hook-like form, or a loop-like structure.

Balls are intended to be inserted for storage within the cylindrical housing through either open end of the cylindrical housing. However, the uppermost end may, if desired, be totally closed. Thus, balls would be restricted for insertion within the cylindrical housing through only the open end of the cylindrical housing having the two arcuately shaped plates disposed located adjacent thereto. Alternatively, balls may be inserted within the housing by passing through the uppermost end, located opposite the end having the adjacently located arcuately shaped plates. Such balls may be positioned into any one of the preferred locations, as determined by the locations of the aforementioned protrusions or projections. It should be noted that such protrusions or projections each reside along the length of the interior of the cylindrically shaped housing and, two or more of which can be utilized to retain any one ball in a preferred location by disposing such two or more of such protrusions in a plane, which plane extends substantially normal to the longitudinal axis of the cylindrical housing. Such protrusions or projections should be configured to restrict, rather than prevent, the repositioning of a ball from a preferred location to another preferred locations.

The arcuately shaped plates are secured to the interior of the housing at or about opposite interior ends thereof, at one end, and have the free ends of each such curved plates extend along the circumference of the interior of the housing so as to be in spaced apart relationship, each occupying somewhat less than ninety degrees of such circumference.

The cylindrical housing, projections, and arcuately shaped plates may be unitary in constructions and are preferably fabricated from a plastic material such as a high density polyethylene or polypropylene-like material. Such materials may be transparent or opaque, since the user may view the ball through either open end, or through the elongated notch.

The entire apparatus, including two or more balls may be enclosed within a prestressed transparent plastic material. Such plastic material, such as polyethylene, may be exposed to heat and caused to "shrink" down onto the exterior portions of the housing, encapsulating the housing and balls therewithin, including, if desired, sales literature and other articles in commerce. As such, the encapsulated holder and balls may be sold over the counter making a neat and, if desired, package, which package may have the components thereof protected from moisture, the weather, and other harmful environments.

If desired, the apparatus can be configured to retain only one ball therein, or, in the alternative, as many balls as is desired.

Not only is the present invention suitable for carrying about tennis balls, but in like fashion, golf balls, baseballs, Ping-Pong balls, and other spherical objects may be housed and dispensed. In addition, pucks, and other small but circular game devices may be so stored and dispensed.

Now referring to the figures, and more particularly to the embodiment illustrated in FIG. 1 showing the present invention 10 includes a substantially cylindrical housing 12 having an open end 14, at the uppermost regions thereof, and, a lowermost open end 16. It should be noted that side wall 18 of the housing 12, disposed adjacent the uppermost end 20 thereof taper inwardly, towards the longitudinal axis of the housing, not shown. Lowermost end 22, may also extend inwardly slightly, if desired. Alternatively, lowermost end may be of the same exterior diameter as is midregion 24.

Elongated notch 26 is shown extending downwardly from uppermost open end 14, terminating at bottom region 28. Bottom region 28 may, if desired, "break through" and extend into lowermost open end 16, if desired. Projections 30 secure ball 32 in the position shown, preventing ball 32 from moving in the direction of arrow 34. Uppermost end 20 of housing 12, by being curved inwardly, prevent ball 32 from emerging upwardly and outwardly from opening 14, in a direction opposite to arrow 34. Projections or protrusions 30 permit ball 32 to be positioned in the position shown occupied by ball 36, upon the application of a sufficient force, at point 38, on ball 32. Such force may be applied by the thumb of the user, not shown. Ball 36, as shown, occupies a position adjacent open end 16 of housing 12. Protrusions 38 prohibit ball 36 from passing upwardly, in a direction opposite to arrow 34, unless a substantial force is applied to the bottom of ball 36. Dotted lines 40 and 42 depict the points of engagement of boss 110 with the exterior surface of housing 12. Arcuately shaped plates 44 and 46 are secured to interior wall 48, of cylindrical housing 12, at points 50. Free ends 52 and adjacent regions of plates 44 and 46 are free standing from interior surface 48. Inwardly extending flange-like lip portions 54, being portion of arcuately shaped plates 44 and 46, each define ball contacting edges 56. Edges 56 extend inwardly so as to engage portions of ball 36 and prohibit the emergence of ball 36 outwardly through opening 16 unless arcuately shaped plates 44 and 46 are forced to extend radially outwardly, in the directions of arrows 58 and 60 by an applied force, in the direction of arrow 34, when applied to ball 36. At all other times, plates 44 and 46 prohibit the accidental emergence of ball 36, in the position shown, or, prevent the emergence of ball 32, when ball 32 is positioned at the location shown occupied by ball 36. It can be seen that notch 26 can extend through to end 16, yet permitting arcuately shaped plates 44 and 46 to be totally effective as an overcomeable means for retaining a ball at a location adjacent the ball dispensing end of the apparatus.

Clip-like mechanism 62, comprising a plastic or metallic clip has one leg 64 thereof secured to boss 110. Leg 66, shown having free end 68, resides in frictional clamping contact with leg 64, permitting a belt or other portion of an article of clothing to pass thereinbetween, at 70, causing the apparatus to be carried about by the user and to be disconnected from engagement with the user's clothing, by simply withdrawing the entire apparatus upwardly in a direction opposite to arrow 34. Alternatively, loop-like structure 72 may have legs 74 thereof affixed to boss 110, forming opening 76 thereinbetween. Opening 76 may be utilized by passing a portion of a belt or other portion of clothing thereinthrough, thereby providing vertical support for apparatus 10 during the playing of a game. It should be stated that boss portion 110 and devices 62 or 72 may be unitary in construction, such as suitable plastic materials, and common with the material utilized to fabricate cylindrical housing 12.

Figure 5:
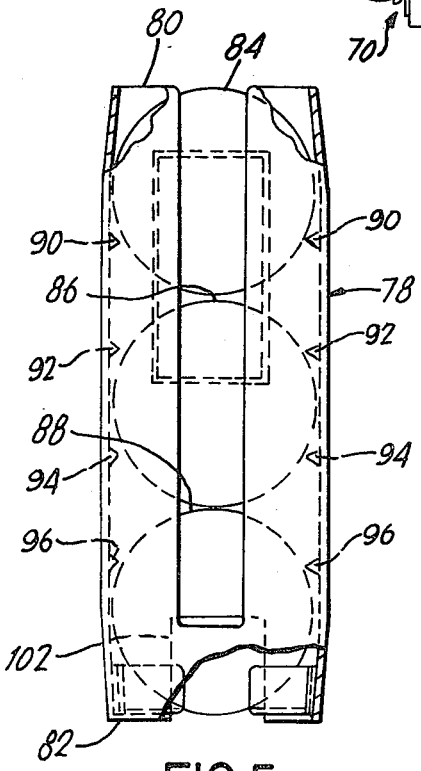
FIG. 5 is a side elevational view, partially shown in cross section, of an alternate embodiment of the apparatus shown in FIG. 1.

FIG. 5 depicts apparatus 78, identical to that of the apparatus shown in FIG. 1, excepting that ends 80 and 82 are separated a distance substantially equivalent to three balls, namely 84, 86, and 88. Protrusions 90 secure ball 84 in the position shown. Protrusions 92 and 94 secure ball 86 in the position shown. Here, two sets of protrusions are required to secure an intermediate ball, such as ball 86, at a central position, not otherwise adjacent to open end 80 or 82. Such pairs of protrusions, each located at upper and lowermost regions of an intermediate ball would be required for any number of balls employed above two in number. It should be understood that the protrusions shown are substantially pyramidal in shape, but such protrusions may be radially extending inwardly from disposed arcuately shaped protrusion, each extending entirely circumferentially or partially circumferentially inwardly from the interior surface of the embodiment illustrated in FIG. 1 or FIG. 5.

Figure 2:
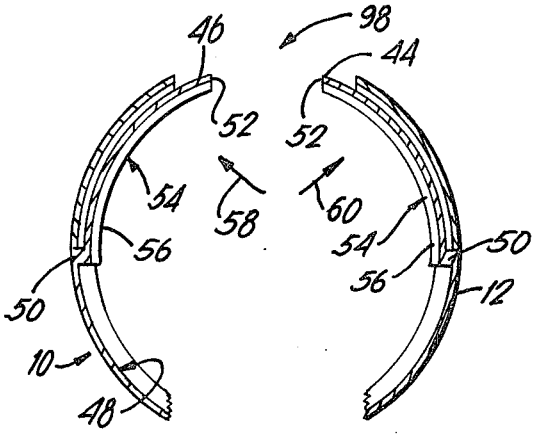
FIG. 2 is a plan cross sectional view, of a portion of the present invention shown in FIG. 1, taken along lines 2—2, viewed in the direction of arrows 2—2.
Figure 3:
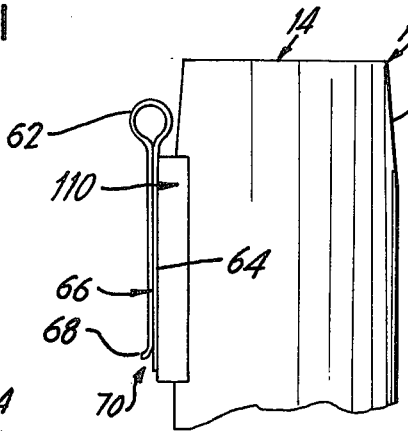
FIG. 3 is a side elevation view of a portion of the apparatus shown in FIG. 1.
Figure 4:
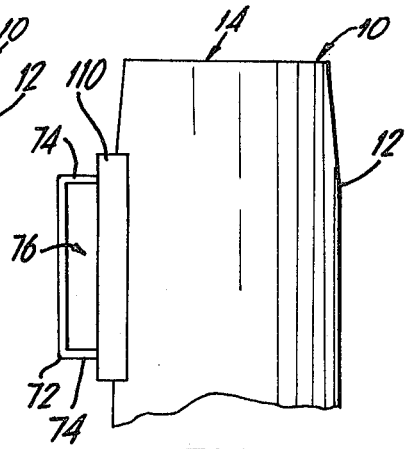
FIG. 4 is a partial side elevation view of an alternate embodiment of a portion of the apparatus shown in FIG. 1.

Lowermost notch 98, shown in FIG. 2, describes another notch extending into open end 16, shown by dotted lines 100 therein. Lowermost notch 98 is reflected by equivalent dotted lines 102, shown in FIG. 5. Such notches, namely, 98 and the notch shown by dotted lines 102, facilitate the easy emergence, when desired, of lowermost balls 36 and 88 respectively from the cylindrical housings shown in apparatus 10 and 78.

Figure 6:
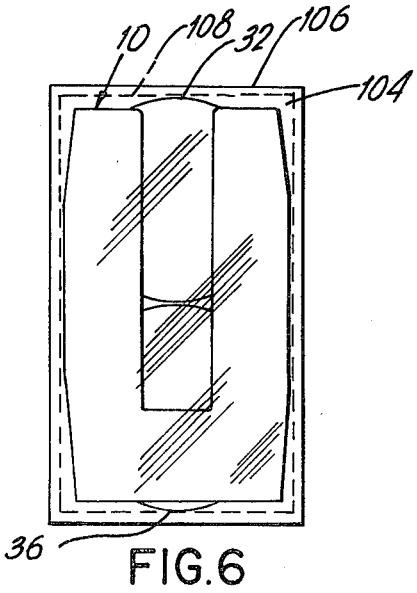
FIG. 6 is a front elevation view of the apparatus shown in FIG. 1, shown enclosed within a outer wrapper.

FIG. 6 illustrates apparatus 10 shown enclosed within a transparent, glass-like plastic envelope 104. Marginal edges 106, of envelope 104, may be secured together, along dotted lines 108, utilizing a heat sealing process, well known in the art. After the application of heat to prestressed biaxially oriented shrink plastic film, such as polyethylene, will cause plastic film 104, to assume the shape of apparatus 10 and cover exposed regions of balls 32 and 36 effectively.

One of the advantages of the present invention is a ball holder and dispenser in which an unlimited number of balls may be easily stored, easily withdrawn, and carried about during the playing of various games.

Another advantage of the present invention is a ball holder and dispenser which is light in construction, inexpensive to manufacture, and particularly suited for its intended use.

Still another advantage of the present invention is a ball holder and storage container which positions one or more balls in preferred locations along designated positions of a common storage track, thereby eliminating the possibility of one ball rubbing on another, causing the exterior surface of such balls to become degraded, worn, or otherwise subject to undue forces.

Yet another advantage of the present invention is a ball carrying dispensing container which permits the dispensing of balls outwardly through a specially prepared dispensing end, without requiring the user to insert more than one finger into the apparatus during the dispensing mode of operation thereof.

A further advantage of the present invention is a container for carrying balls about which may be utilized during the sale of such balls as a storage container.

Another advantage of the present invention is a ball dispenser which may be easily secured to a portion of the user's clothing, in one mode of operation, acting as a storage device for the balls, in another mode of operation, and also acting as a container, suitable for the sale of such balls. Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A ball holder and dispenser comprising a substantially right angle cylindrical housing, one end of said housing being open, the other end of said housing having a notch communicating thereto, said notch extending along a portion of the length of said housing parallel to the longitudinal axis thereof, a pair of arcuately shaped plates, one end of each of said pair of plates being secured to the interior of said housing at a point adjacent said open end thereof, said pair of arcuately shaped plates extending inwardly a greater distance towards the center of said housing than a portion of said housing located adjacent said open end thereof, at least one protrusion. said at least one protrusion secured to the interior of said housing, said at least one protrusion configured to releasably retain a ball at at least two preferred locations within said housing, means to manually release said ball from engagement with said at least one protrusion, means to removeably secure said housing to a portion of an article of clothing of user thereof.

2. The apparatus as claimed in claim 1 wherein the other of said ends of said housing is open, said notch extending into said other open end.

3. The apparatus as claimed in claim 1 wherein said pair of arcuately shaped plates include an inwardly directed flange-like portion thereof, said flange-like portion disposed adjacent said open end of said housing.

4. The apparatus as claimed in claim 1 wherein said means to removeably secure comprises a hook-like element.

5. The apparatus as claimed in claim 1 wherein said means to removeably secure comprises a loop-like element.

6. The apparatus as claimed in claim 1 wherein the other end of said housing is configured to have a smaller internal diameter than a region of said housing disposed adjacent the central portions thereof.

7. The apparatus as claimed in claim 1 comprising a unitary construction.

8. The apparatus as claimed in claim 1 further comprising a plurality of protrusions, said plurality of protrusions extending radially inwardly from an interior portion of said housing, said plurality of protrusions each being configured to engage a first portion of the surface of a ball and a second portion of the surface of said ball, said ball being releasably retained at a fixed location within said housing, said housing having an internal length greater than the diameter of said ball.

9. The apparatus as claimed in claim 1 comprising another notch, said another notch extending into said open end of said housing, said another notch being located on a side of said housing opposite the side of which said notch is disposed.

10. The apparatus as claimed in claim 1, wherein said at least one protrusion is configured to releasably retain another ball located in said housing out of touching engagement with said ball.

* * * * *